United States Patent [19]

Cobaugh et al.

[11] Patent Number: 4,579,411

[45] Date of Patent: Apr. 1, 1986

[54] LATCH SYSTEM FOR ZIF CARD EDGE CONNECTORS

[75] Inventors: Robert F. Cobaugh, Elizabethtown; James L. Fedder, Harrisburg, both of Pa.

[73] Assignee: AMP Incorporated, Harrisburg, Pa.

[21] Appl. No.: 477,058

[22] Filed: Mar. 21, 1983

[51] Int. Cl.[4] ..... H01R 9/09

[52] U.S. Cl. ..... 339/75 MP; 339/91 R; 339/176 MP

[58] Field of Search ..... 339/75 MP, 91 R, 176 MP

[56] References Cited

U.S. PATENT DOCUMENTS

| | | | |
|---|---|---|---|
| 2,802,188 | 8/1957 | Badders | 339/176 MP |
| 2,825,037 | 2/1958 | French | 339/17 |
| 3,216,580 | 11/1965 | Fricker, Jr. | 211/41 |
| 3,932,016 | 1/1976 | Ammenheuser | 339/65 |
| 3,982,807 | 9/1976 | Anhalt et al. | 339/176 MP |
| 4,017,138 | 4/1977 | Evans | 339/75 MP |
| 4,417,778 | 11/1983 | Halvorsen et al. | 339/75 MP |

FOREIGN PATENT DOCUMENTS

| | | | |
|---|---|---|---|
| 2732519 | 2/1979 | Fed. Rep. of Germany | 339/75 MP |

OTHER PUBLICATIONS

IBM Technical Disclosure Bulletin, vol. 14, No. 9, 2/1972, "Twin-Contact Connector"; Colletti et al.

*Primary Examiner*—John McQuade

*Attorney, Agent, or Firm*—Allan B. Osborne

[57] ABSTRACT

The present invention relates to card-latching systems on zero insertion force card edge connectors. More particularly, the latching system includes spring members having the lower ends thereof secured to the lower housing of the connector at each end of the card edge receiving slot and a concavo-convex intermediate section extending through a cam member attached to the vertically moving upper housing so the upper ends of the spring members are cammed in and out of engagement with the card inserted in the connector.

1 Claim, 12 Drawing Figures

28
40
30
24
26
22
18
20
56
28
42
40
48
30
24
14
26
12
44
16
16
56
54
28
60
22
50
40
42
52
54

56
28
60
22
50
52
42
28
54

50
52
54
42
48

62
50
64
42

LATCH SYSTEM FOR ZIF CARD EDGE CONNECTORS

BACKGROUND OF THE INVENTION

1. Field of the Invention

The invention disclosed herein relates to card latching systems on card-edge connectors of the type having a vertically moving upper housing to cam contact elements into and out of engagement with the card. Such latching systems retain the card in the connector slot against vibrational-induced movement, against unintentional withdrawal, and against the frictional force of the contact elements as the wipe against the card.

2. Prior Art

The present invention is a novel improvement and a departure from at least the following:

| U.S. Pat. No. | Patentee |
|---|---|
| 4,017,138 | Evans |

Evans discloses a card edge connector having a vertically moving member mounted in the slot of the base with openings in the member through which contact elements extend. The inserting card forces the member down so that cam surfaces defining the openings cam the contact elements against the card. Concurrently, latch arms on the base and moving member cooperate to force latch surfaces at the upper ends of elongated arms over an end of the card to retain it in the connector. Further, the movement cocks a second set of arms which, when actuated, withdraws the latch surfaces from the card ends to permit the card withdrawal.

In addition to Evans, prior art patents having latching devices unrelated to contact element camming mechanisms include:

| U.S. Pat. No. | Patentee |
|---|---|
| 2,825,037 | French |
| 3,216,580 | Fricker, Jr. |
| 3,932,016 | Ammenheuser |

French locks a card to a circuit board by means of spring clips which are secured to the board at one end and have a free end extending upwardly and inwardly over a slot in the board. As the card is inserted into the slot, the free ends snap into perforations in the opposing sides of the card to hold it in place.

Fricker, Jr. incorporates resilient members attached to card guides positioned at each end of a card edge connector. A nose-like projection is attached to the upper members so that an inserting card, riding on the slanting surface, cams the upper member away and as the card is driven home, the projection enters a notch on the side of the card to retain it in the connector. The projection is withdrawn by moving the upper members outwardly.

Ammenheuser discloses a similar device as did Fricker, Jr. A resilient catch is an integral part of card guides positioned at each end of a card edge connector. The noselike projection on the catch performs in substantially the same way as the Fricker, Jr. device.

SUMMARY OF THE INVENTION

The present invention is a latching system which includes a spring member having an upper end which is cammed inwardly to engage the sides of a card inserted in the card edge-receiving slot in the connector. The camming occurs concurrently with the vertical movement of the upper housing of the connector which causes contact elements therein to contact and wipe the traces on the card.

DESCRIPTION OF THE INVENTION

Figures 1, 2, 4, 6, 7:
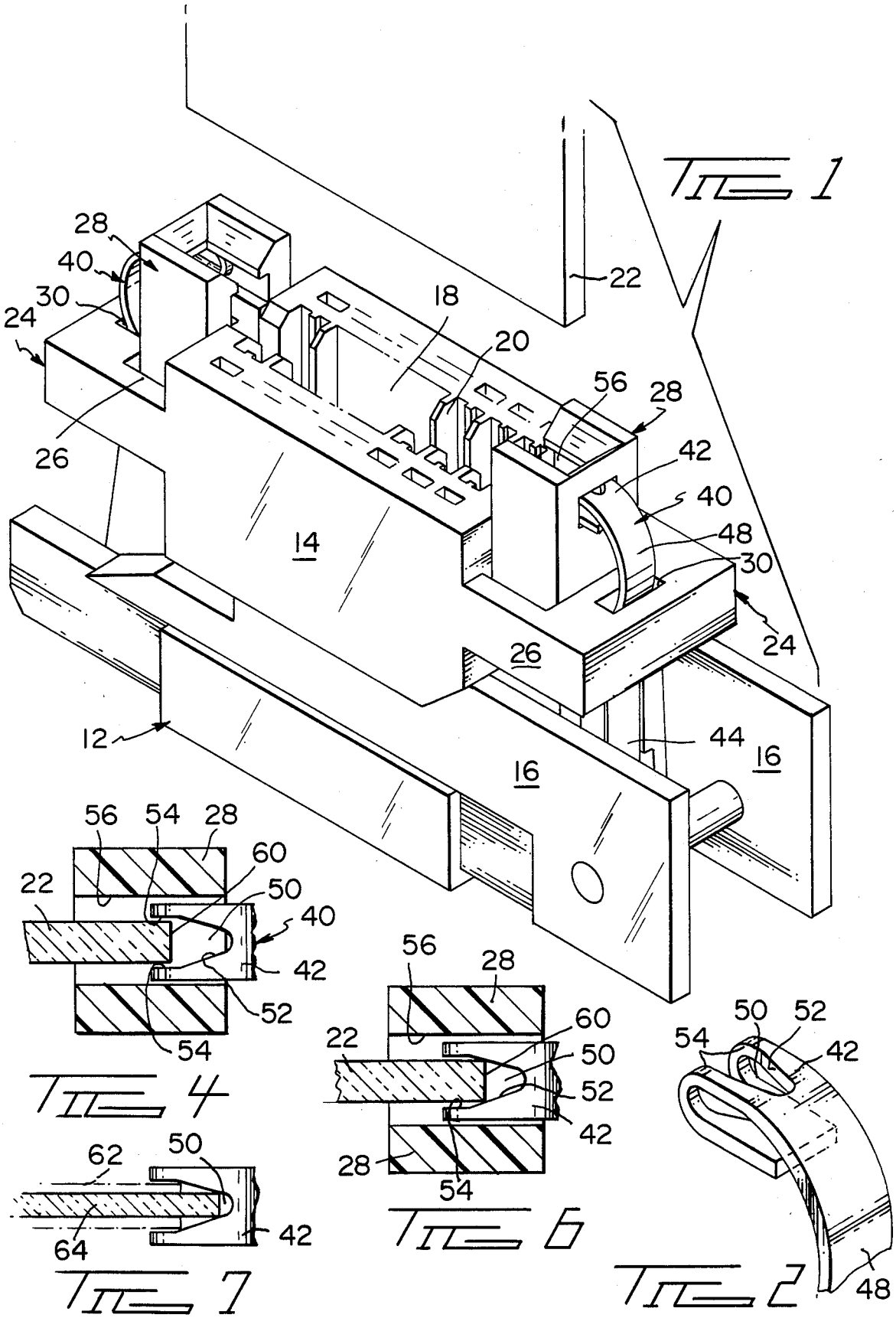
FIG. 1 is a perspective view of a zero insertion force card edge connector having thereon the card latching device of the present invention.
FIG. 2 is an isometric view of the card gripping upper end of the spring member of the latching device.
FIG. 4 is a top sectional view taken along line 4—4 in FIG. 3.
FIG. 6 is a top sectional view taken along line 6—6 in FIG. 5.
FIG. 7 is a view similar to FIGS. 4 and 6 showing the adaptability of the card latching device to cards of varying widths.

The card edge connector 10 shown in FIG. 1 has a stationary base or lower housing 12 and a vertically movable upper housing 14. Cams 16, riding on ramps (not shown), drive the upper housing. With the connector in an open position, the free ends of contact elements (not shown) which extend up into the upper housing on either side of card receiving slot 18, are recessed in cells 20. Card 22 may be freely inserted into the slot. When the upper housing is moved vertically upwardly, the free ends are forced into slot 18 to engage conductive traces on the card. This type of connector is referred to as a zero insertion force or "ZIF" connector and is available from manufacturers such as AMP Incorporated of Harrisburg, Pa.

The camming action which forces the contact element free ends inwardly against the card also results in the ends sliding upwardly on the traces to wipe them. The camming forces, however, are such that the upwardly moving free ends carry the card with them. When this happens, wipe cannot occur. Also, under extreme vibratory motion, the card can move and, particularly in high density ZIF connectors, cross circuiting can occur. Accordingly, ZIF connector 10 has been modified by attaching thereto the latching system of the present invention. This system prevents the inserted cards from moving. It also prevents one from inserting a card into a closed connector which would damage the contact elements. The latching system includes support members 24 which are attached to the longitudinal ends of upper housing 14 and project outwardly therefrom. The attachment to the upper housing is by legs 26 which straddle card guides 28 which are fixed to and extend upwardly from lower housing 12. These guides are located adjacent each end of slot 18. Support members 24 move vertically with upper housing 14.

Figure 3:
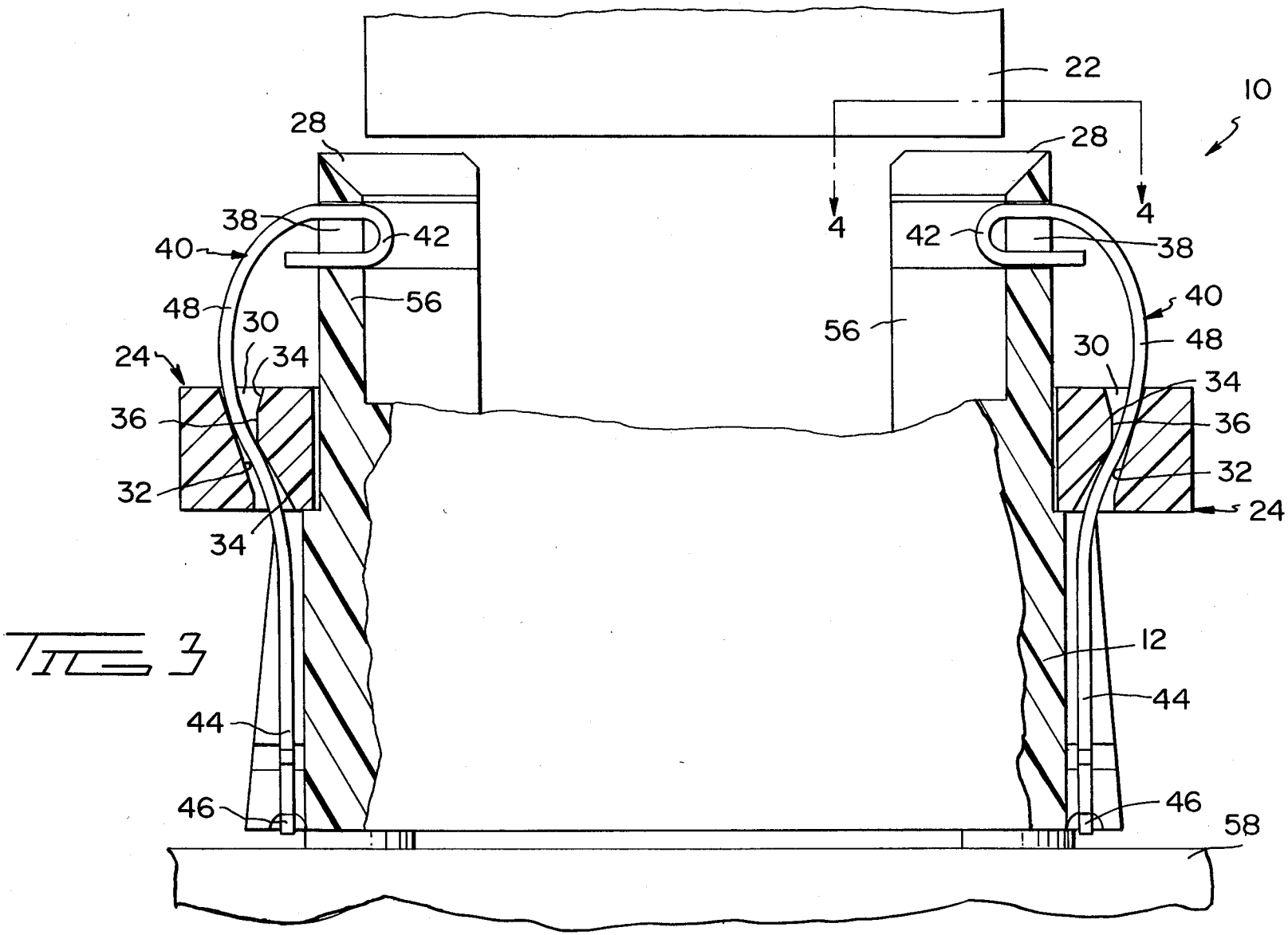
FIG. 3 is a cross-sectional view showing the card edge connector and the card latching device in an open position.

A non-linear cam passage 30 extends vertically through each support member. The shape of the walls defining this passage is shown in FIG. 3 to which reference is now made. The outer wall, indicated by reference numeral 32, slopes in (e.g., towards slot 18) from the top or upper opening of the passage downwardly to just above the lower opening. The wall is vertically straight thereafter to provide a large lower opening. Inner wall 34 has a convex shape with the apex, indicated by reference numeral 36 being less than halfway down the length of the passage as measured from the upper opening thereto. The lower section of the wall; i.e., below apex 36, slopes steeply inwardly. Accordingly, the passage is narrowest adjacent the apex and widens above and below it as shown.

The latching system requires modifying each card guide 28 by providing horizontal opening 38 therethrough just below the top or free end.

Finally, the latching system includes elongated spring members 40. With continued reference to FIG. 3, both members are identical, one to the other. The preferred material from which they are made is stainless steel. The free or upper end, as seen in profile, is bent down and back in to define nose 42. The lower end of each spring member, generally indicated by reference numeral 44, is relatively straight with the free end 46 thereof being secured to lower housing 12 by any conventional means. The section between and joining the upper and lower sections; i.e., intermediate section 48, is bent into a concavo-convex shape with the concave surface facing inwardly. The spring members extend through cam passages 30 and the noses are positioned in and restrained by horizontal openings 38 in card guides 28.

With the exception of nose 42, the spring members are flat across as seen in FIG. 1. With respect to nose 42, reference will now be made to FIGS. 2 and 4. The drawing therein shows the nose of a spring member and a fragment of intermediate section 48. The drawing shows that the nose is bifurcated by a generally V-shaped slot 50. The walls 52 defining the slot preferably are parallel to each other adjacent the opening as indicated by reference numeral 54. As seen in FIG. 4, walls 52 begin to converge in from the parallel section.

FIG. 3 is a view of connector 10 with the latching system of the present invention attached thereto. The connector is shown in an open position; i.e., ready to freely admit card 22 into slot 18. The noses 42 of spring members just intrude into guide grooves 56 in each card guide 28. FIG. 3, as well as FIG. 5, shows connector 10 mounted on printed circuit board 58.

FIG. 4 is a view looking down, showing a side 60 of card 22 in alignment with slot 50 in one nose 42.

Figure 5:
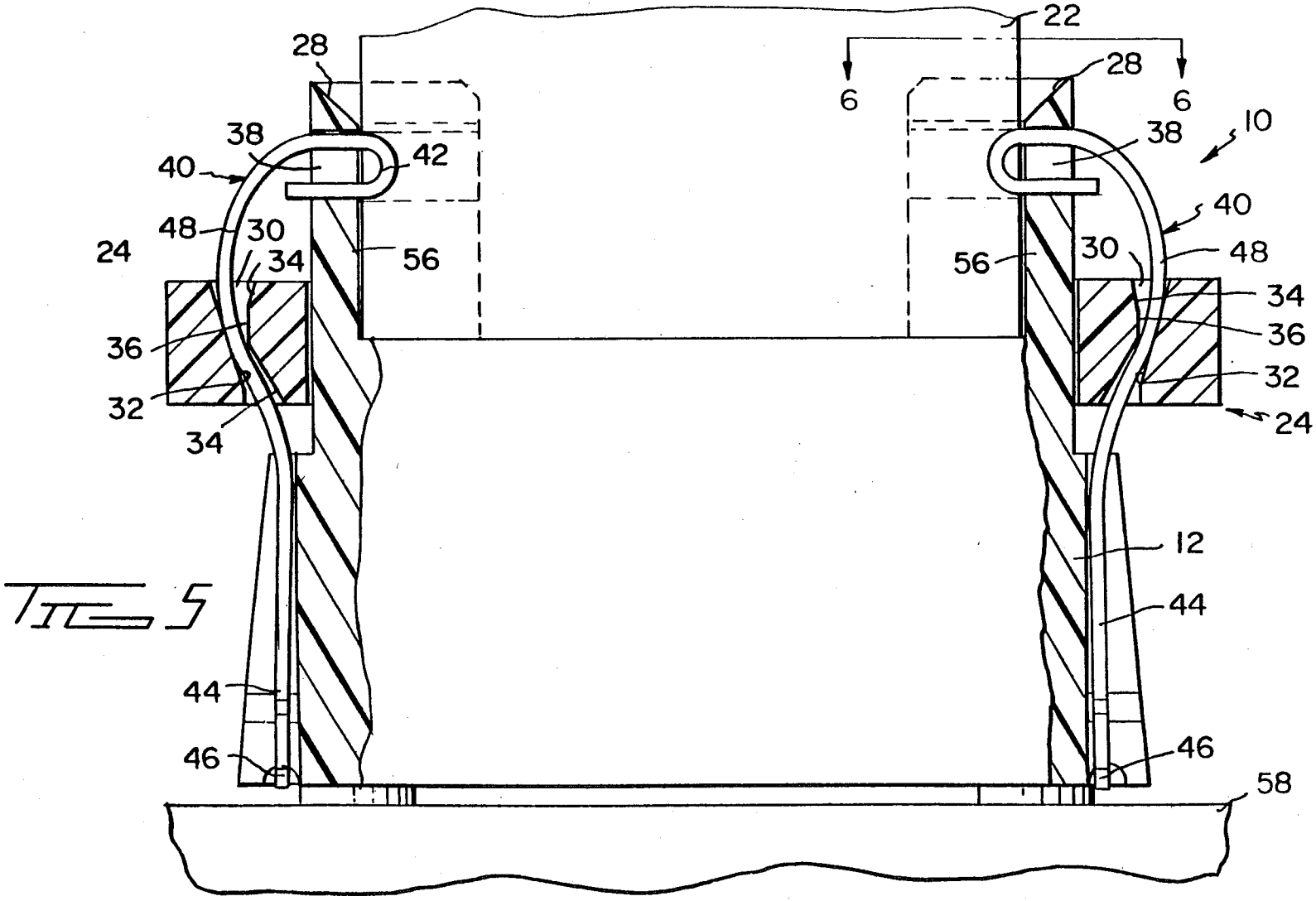
FIG. 5 is a cross-sectional view showing the card edge connector and the card latching device in a closed position.

FIG. 5 is a view of connector 10 in a closed position; i.e., card 22 has been inserted into slot 18, the upper housing moved upwardly to drive the contact elements into engagement with the card and concurrently therewith noses 42 cammed inwardly whereupon the opposing walls 52 of slots 50 grip sides 60 to hold the card.

FIG. 6 is a view looking down showing a side 60 wedged in between the opposing walls 52.

The noses are moved inwardly by the walls of cam passages 30 acting on intermediate sections 48. As support members 24 moved upwardly with upper housing 14, inclined outer walls 32 of the passages pressed against the convex surface of the intermediate sections. This causes noses 42 to move inwardly to grip the card sides. FIG. 5 shows outer walls 32 bearing against the spring members.

The noses are moved out of contact with the sides by apex 36 on inner walls 34 pushing on the concave surface of the intermediate sections as the support member moves downwardly. FIG. 3 shows the apexes against the spring members.

FIG. 7 illustrates how the V-shaped slot 50 accepts cards of varying widths. Two cards are shown; card 62 being one having the maximum permitted width and card 64 being one having the minimum permitted width. The depth nose 42 intrudes into groove 56 is a function of the card width; i.e., the nose moves in until walls 52 of the slot engage sides 60. In the case of a maximum width card, support member 24 would still be moving upwardly when this occurs. Further upward travel is not impeded since spring member 40 is resilient and the concavo-convex intermediate section will resiliently distort after the nose stops moving in.

FIGS. 8 through 11 illustrate a second embodiment of the latching system of the present invention.

Figure 8:
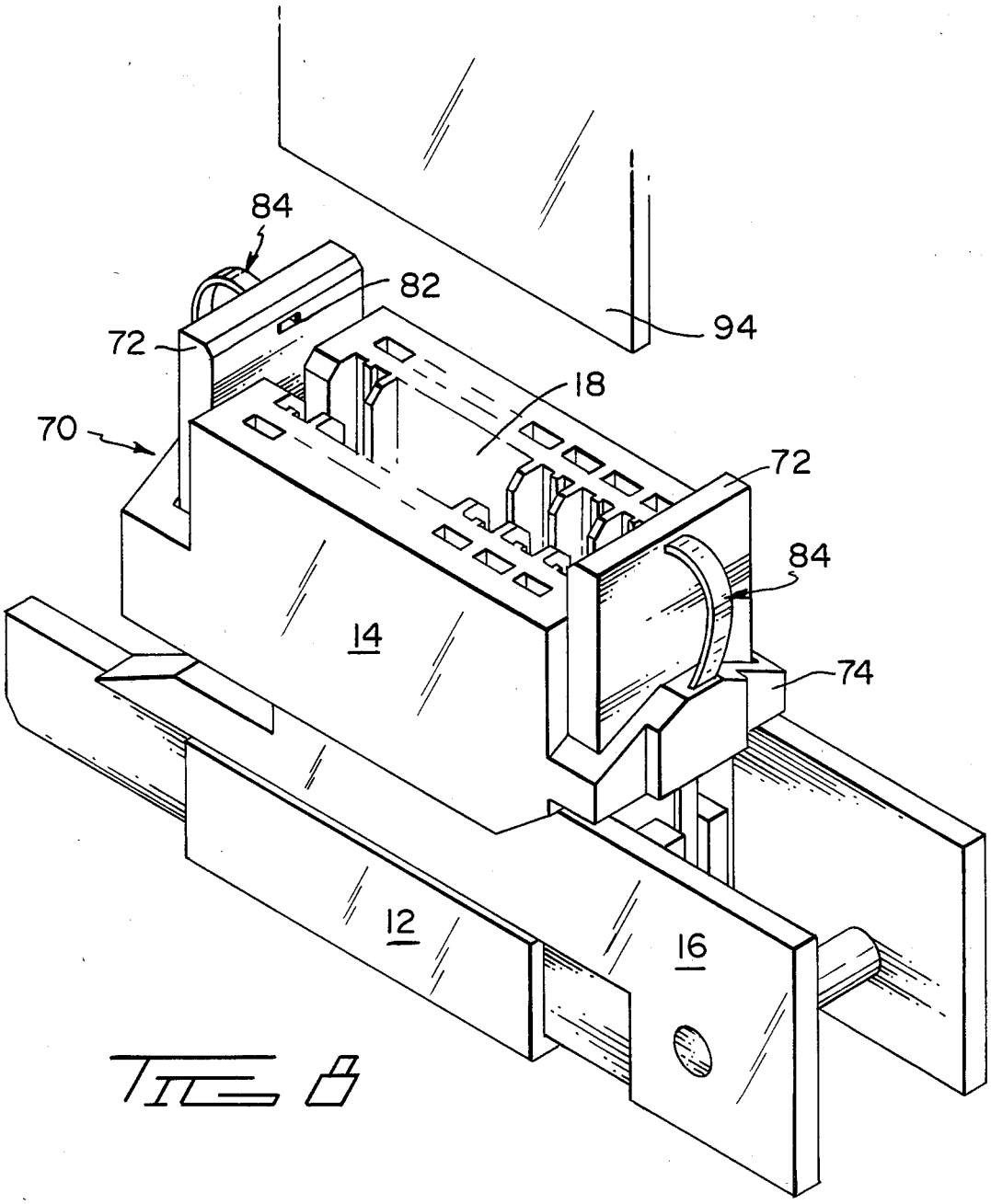
FIG. 8 is a perspective view of an alternative embodiment of the card latching device of the present invention.
Figure 9:
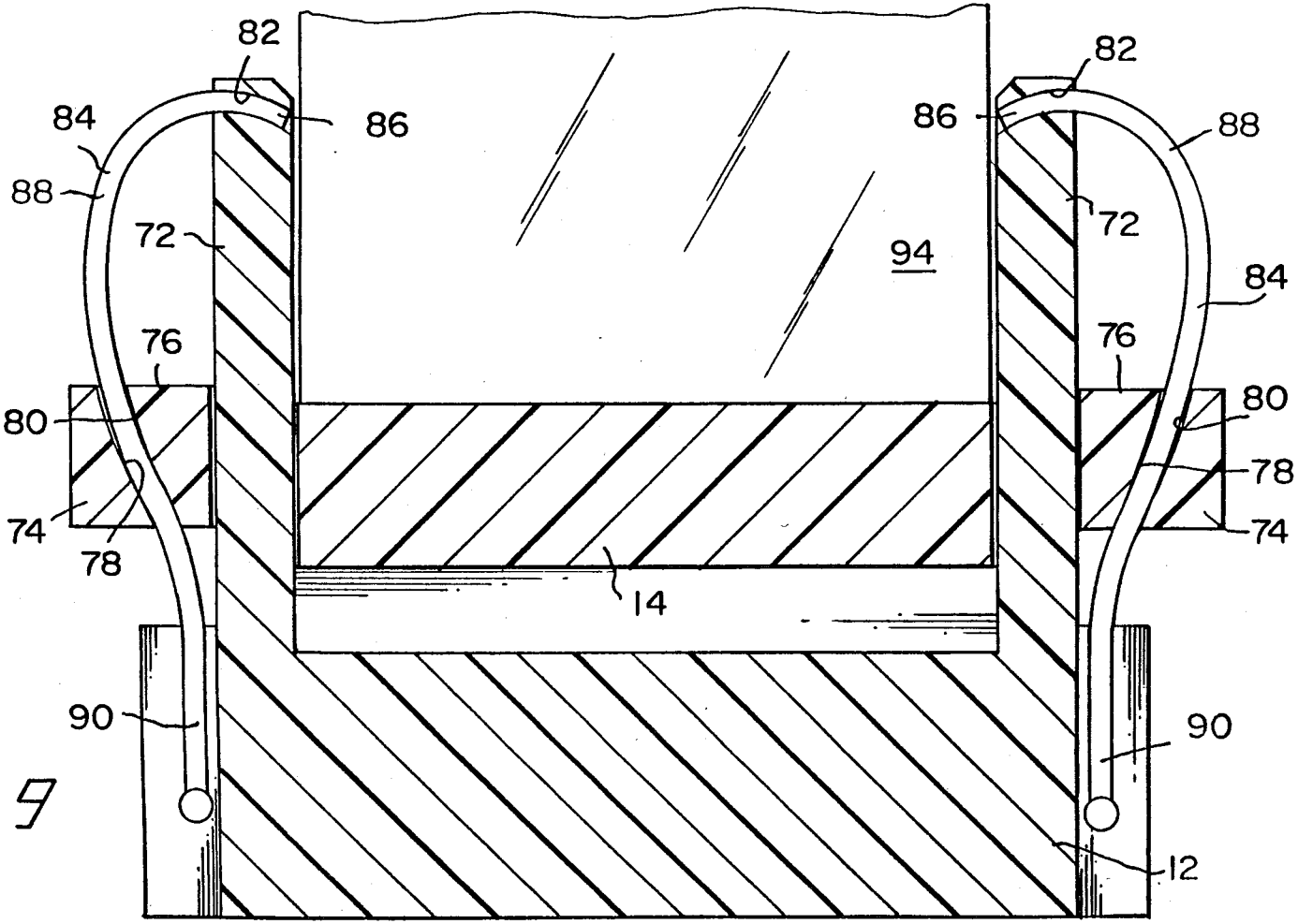
FIG. 9 is a cross-sectional view showing the card edge connector and the card latching device of FIG. 8 in an open position.
Figure 10:
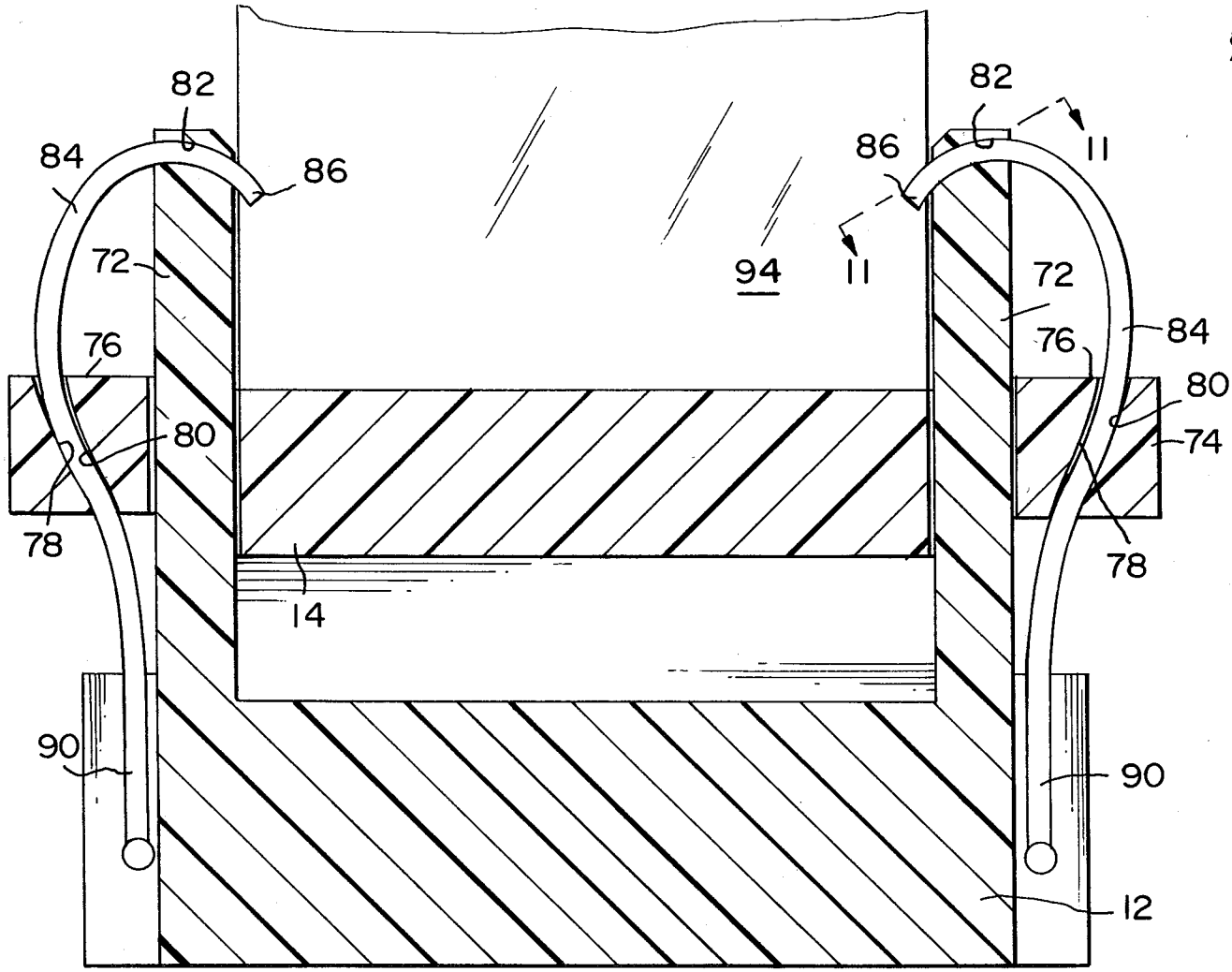
FIG. 10 is a cross-sectional view showing the card edge connector and the card latching device of FIG. 8 in a closed position.

Connector 70 shown in FIGS. 8–10 differs from connector 10 in not having card guides. End plates 72 are positioned at either end of card-receiving slot 18 instead of card guides. Support members 74, attached to the upper housing 14, are provided with cam passages 76. Inner and outer walls 78 and 80, respectively, curve inwardly from top to bottom and are parallel, one to the other. FIGS. 9 and 10 show these passages. Each end plate is provided with an opening 82. As can be seen in FIG. 9, the openings curve down from the outside to the inside of the plates.

Spring members 84 include curved nose 86 at the upper end, a concavo-convex shaped intermediate section 88 and a lower section 90 which is secured to lower housing 12 by any conventional means. The spring members pass through cam passages 76 with the noses 86 positioned in openings 82.

Figure 11:
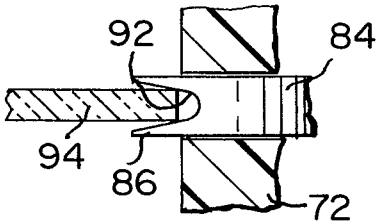
FIG. 11 is a sectional view taken along line 11—11 in FIG. 10.

In the embodiment shown in FIG. 11, the free end of nose 86 is provided with V-shaped notch 92.

Connector 70 with the second latching system embodiment shown in FIGS. 8–11 functions substantially the same as the first latching system embodiment of FIGS. 1–7. As the support members moves upwardly, spring members 84 are cammed so that noses 86 move in towards card 94 positioned in slot 18. The card sides enter notches 92 until the corners engage the notch walls as shown in FIG. 11. As shown in FIG. 10, the noses are pointing obliquely downwardly which increases the retaining forces against the card.

Figure 12:
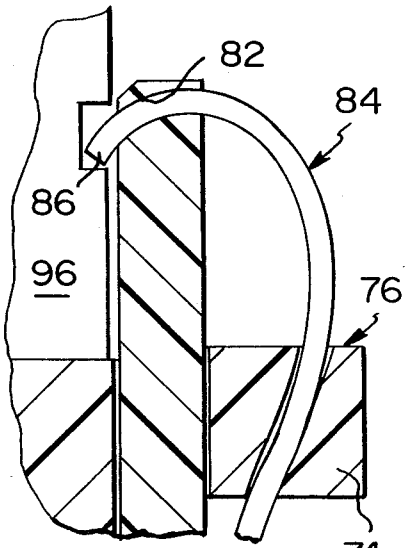
FIG. 12 is a view of an alternative embodiment of the card latching device of FIGS. 8–11.

FIG. 12 shows a slightly different embodiment to that shown in FIGS. 8–11. In this embodiment, nose 186 on spring members 84 is not notched but card 96 is as indicated by reference numeral 98. The squared off noses enter the side notches as the spring members are cammed in to hold the card in place.

The foregoing detailed description has been given for clearness of understanding only, and no unnecessary limitations should be understood therefrom, as some modifications will be obvious to those skilled in the art.

We claim:

1. A circuit card latching system for card edge connectors of the type having a vertically moving member for camming contact elements against a card positioned in a card-receiving slot, said latching system comprising:

a. an elongated spring member vertically positioned at an end of the slot with the lower end secured to the connector base, a free upper end having a V-shaped notch projecting in towards the slot and an intermediate section joining the two ends; and b. support means having a camming passage therethrough, said support means being attached to the end of the moving member with the intermediate section slidingly received in the passage so that during vertical travel, the camming passage walls bear against the intermediate section which in turn causes the free upper end to move into the slot to engage and restrain a circuit card in the V-shaped notch which may be in the slot or to move out of the slot so that a card may be inserted thereinto or withdrawn therefrom.

* * * * *